United States Patent [19]

Richard et al.

[11] Patent Number: 4,821,541

[45] Date of Patent: Apr. 18, 1989

[54] TIME LOCK

[75] Inventors: Willy Richard, Convers; Francois Jolidon, La Chaux-de-Fonds, both of Switzerland

[73] Assignee: Relhor S.A., La Chaux-de-Fonds, Switzerland

[21] Appl. No.: 121,252

[22] Filed: Nov. 16, 1987

[30] Foreign Application Priority Data

Nov. 17, 1986 [CH] Switzerland ..... 04585/86

[51] Int. Cl.[4] ..... E05B 43/00

[52] U.S. Cl. ..... 70/272; 70/267

[58] Field of Search ..... 70/272, 267, 268, 269–271, 70/273–274

[56] References Cited

U.S. PATENT DOCUMENTS 4,062,210 12/1977 Uyeda ..... 70/268

4,224,814 9/1980 Bechtiger ..... 70/272

4,269,050 5/1981 Bechtiger ..... 70/272

4,369,641 1/1983 Wallach ..... 70/272

*Primary Examiner*—Robert L. Wolfe

*Attorney, Agent, or Firm*—Sughrue, Mion, Zinn, Macpeak & Seas

[57] ABSTRACT

A time lock, for example for high security locks of safes or strong rooms, comprises at least one spring-driven timing device coupled to a first regulator (35) via a wheel-train (34). One of the wheels (39) of this wheel-train is equipped with a differential mechanism which forms switching means enabling the wheel-train to be coupled to a second regulator (50) comprising a flanged disk (55). Hence, by controlling the switching means, the speed of running of the timing device may be set so as to be able to abruptly free the residual energy of the spring (22a) when the fixed time setting has elapsed. This provides a better determination of the precise instant when the lock is unlocked.

10 Claims, 5 Drawing Sheets

TIME LOCK

BACKGROUND OF THE INVENTION

The present invention concerns time locks and more particularly locks whose operation can be disabled during predetermined time intervals the duration of which can be fixed by one or more timing devices. Such time locks are used principally in protected enclosures such as bank strong rooms and safes to prevent any manual actuation of the door for example during the bank's closing hours.

In this application, the control box of the lock containing notably the timing device and the blocking members of the lock mechanism is preferably mounted on the inside of the door. It is thus desirable, for security reasons, to avoid any electrical connection between the door and the surrounding door frame and for this reason time locks of this type usually include one or more mechanical timing devices able to operate without any source of electricity, i.e. driven solely by means of energy provided by a spring.

Such a mechanical timing device described for example in French patent FR-A-2,435,584 (U.S. Pat. No. 4,269,050) generally comprises a spring-operated adjustable clockwork mechanism whose spring is wound up to a greater or lesser degree to set the variable duration of the count-down time of the timing device.

Members coupled to the spring for the purpose of winding it are generally provided with a dial and an index which display the chosen duration to the user. Once the setting operation has been finished, the spring drives the clockwork mechanism until the selected duration has elapsed.

However, it is possible that the user inadvertently exceeds the duration he wished to select by moving the winding members beyond the position corresponding to the desired duration. It would then be impossible for him to go back unless the winding members or the wheel-train coupling the spring and the regulator include a friction coupling. Apart from encumbering the timing device mechanism, such a coupling does not allow an easy and precise backwards correction to the adjustment and the user would be obliged to resort to trial and error and, to obtain the position corresponding to the desired duration, would have to make several tries.

Furthermore, the blocking members of the lock's linkage system can only be released by supplying a given quantity of energy which must come from the mechanical timing device itself and more specifically from its spring. However, this release necessarily occurs at the end of the movement of the timing device when the spring has already lost most of its stored energy so that there may be problems in overcoming all of the forces necessary to release the lock. Whereas it is possible by calculation to provide a spring with a sufficient residual energy, the precise instant when release is to take place is, to the contrary, uncertain, especially as the timing devices preferably have a maximum adjustable time of 144 hours. Hence, the precision of determining the instant of release is low and may even vary from 30 to 60 minutes if the timing device is set at its maximum period.

DISCLOSURE OF THE INVENTION

The object of the invention is to supply a time lock which does not have the described disadvantages.

The invention thus provides a time lock comprising a blocking member able to prevent manual actuation of the lock during a time interval fixed by at least one mechanical timing device, this timing device being driven by a spring coupled via a wheel-train to a regulating device, characterized in that the timing device comprises a second regulating device and switching means able to selectively connect to said wheel-train either the first regulating device or the second regulating device to adjust the speed of running of the timing device.

Thanks to these characteristics of the invention, it is possible firstly to accelerate running of the timing device at the end of its movemennt and to free the remaining energy of the spring in a very short time whereby this energy may be used for problem-free control of the blocking members of the mechanism in the direction to free the lock. In this case, the switching means may be actuated by a control member fixed to one of the wheels of the timing device mechanism, by switching to the second regulating member when its position corresponds to the end of the fixed time interval.

The invention also enables the running of the timing device to be manually modified either selectively or permanently during an entire time interval in such a way that an incorrect setting may be rapidly corrected or a setting can be made in another range of time intervals, by modifying the scale. In the latter case, the timing device may be provided with a display disk having two scales, one for a long range of time intervals and the other for a short range of time intervals. The time intervals may thus be selected much more precisely than with a timing device having a single range of time intervals with a large maximum setting, for example 144 hours.

BRIEF DESCRIPTION OF DRAWINGS

The invention will be better understood from the following description of an embodiment of the invention.

In the accompanying drawings which are given solely by way of example.

DESCRIPTION OF PREFERRED EMBODIMENT

Figure 1:
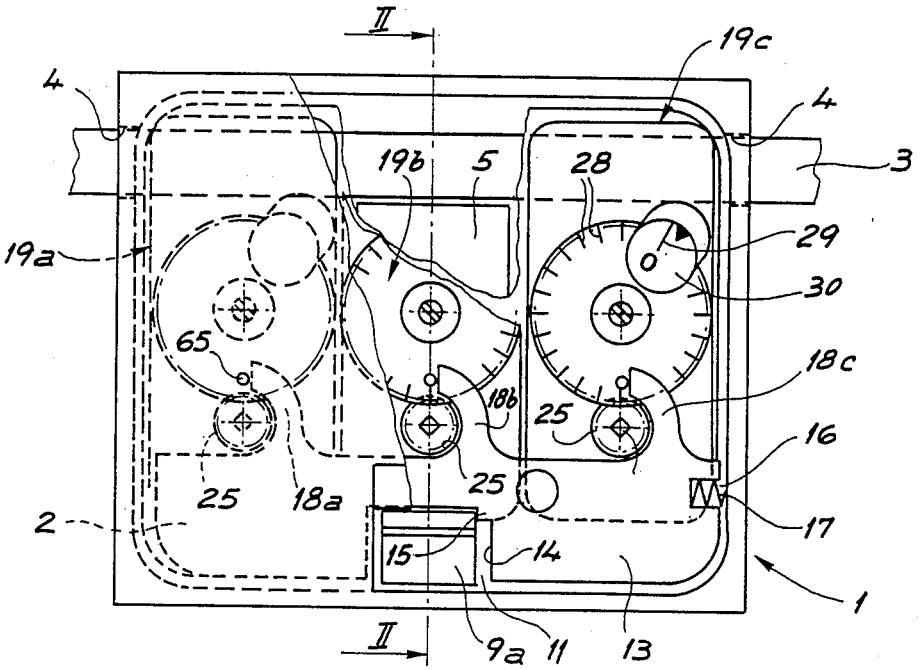
FIG. 1 is a front elevational view of a time lock according to the invention shown in its freed configuration.

According to the embodiment shown in FIGS. 1 to 10, the time lock according to the invention comprises a housing 1 closed by a transparent cover 2 which forms the front wall of the unit. The housing 1 is adapted to be mounted on the door of a strong room, safe or the like provided with a conventional lock mechanism, preferably a combination lock, of which FIGS. 1 to 4 show only a stop bar 3 forming part of the linkage system of the lock. This bar 3 is able to slide in a passage 4 in the housing 1 provided this passage is not obstructed for the purpose of locking by a sliding piece 5 which prevents actuation of the lock in the direction tending to open it.

Figure 3:
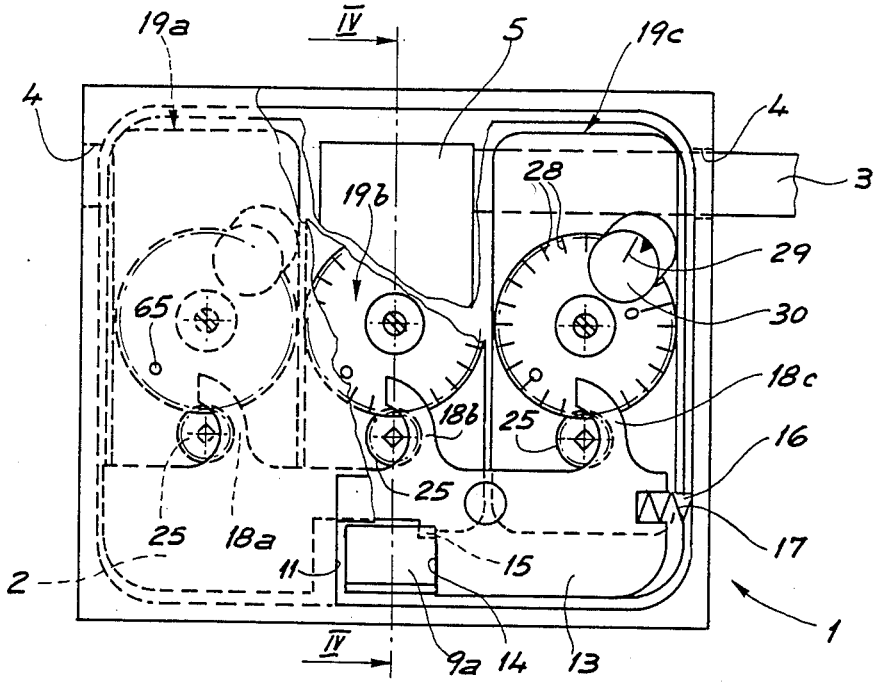
FIG. 3 is a front elevational view of the lock of FIG. 1 in its blocked configuration.
Figure 2:
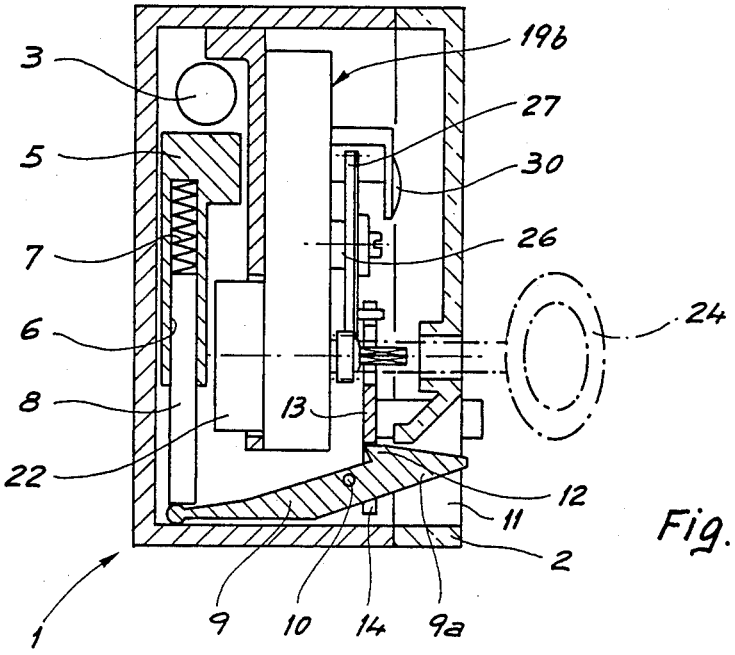
FIG. 2 is a cross-sectional view along line II—II of FIG. 1.

In other words, a sliding piece 55 guided (in this instance vertically) in the housing 1 can obstruct movement of the stop bar 3 by being placed across the passage 4, hence preventing opening of the lock (this opening corresponding to a movement of the bar 3 towards the left of FIGS. 1 to 3). The mechanism of the lock may be of any known type so that a detailed description thereof is unnecessary.

The sliding piece 5 which is mounted approximately in the middle of the housing 1 has a guide hole 6 in which are arranged a spring 7 and a push-piece 8 on which an actuating lever 9 pivotally mounted in the housing 1 about a pin 10 can act.

The actuating lever 9 has a control end 9*a* which protrudes through a window 11 provided in the cover 2 so as to be accessible from the front of the apparatus. It also comprises a locking tip 12 which cooperates with a transmission plate 13 slidably mounted in the housing 1 behind the cover 2.

The transmission plate 13 comprises a notch 14 traversed by the control end 9a of the actuating lever 9. In one of the angles of this notch is provided an abutment 15 which cooperates with the locking tip 12 to fix the transmission plate 13 in position when the lock is in its configuration preventing opening.

The transmission plate 13 is permanently biased to occupy this position by a spring 16 which engages in a cut-out 17 of the plate 13 and which bears against the inner wall of the housing 1.

Finally, the transmission plate 13 further comprises several actuating fingers 18*a*, 18*b* and 18*c* by means of which it can be pushed back against the action of the spring 16 to shift the lock from its configuration preventing opening (FIGS. 3 and 4) to its position authorizing opening (FIGS. 1 and 2).

The time lock also comprises several timing devices 19*a*, 19*b* and 19*c* which are all identical and cooperate respectively with the actuating fingers 18*a*, 18*b* and 18*c*, and are fixedly mounted in the housing 1.

The provision of several timing devices (namely three) provides a redundancy for security reasons in order to reduce the risk that a breakdown of one timing device may prevent any possibility of opening the protected enclosure. In cases where a lower security factor would be acceptable it would of course be possible to provide only two timing devices or even only one. It is noted here that the construction of the three timing devices is exactly the same so that only one will be described.

Figure 4:
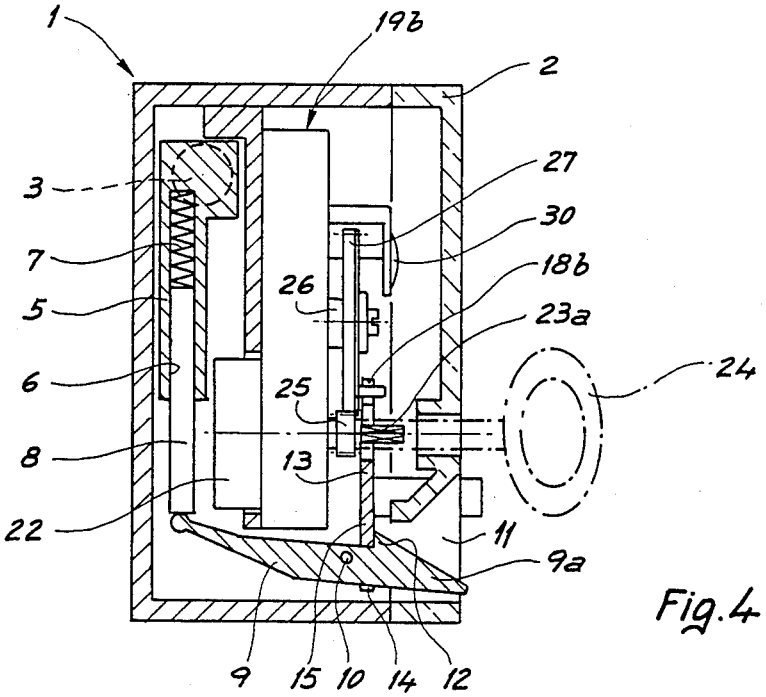
FIG. 4 is a cross-sectional view along line IV—IV of FIG. 3.
Figure 5:
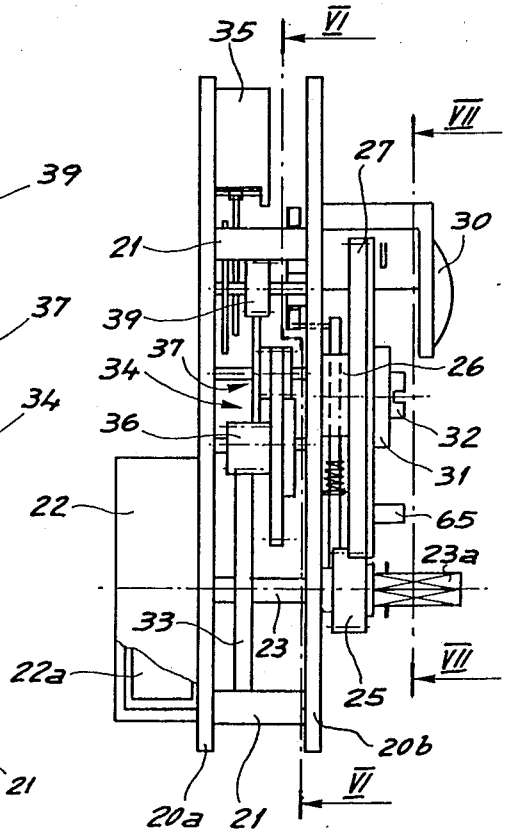
FIG. 5 is a side elevational view of one of the timing devices of the time lock.
Figure 6:
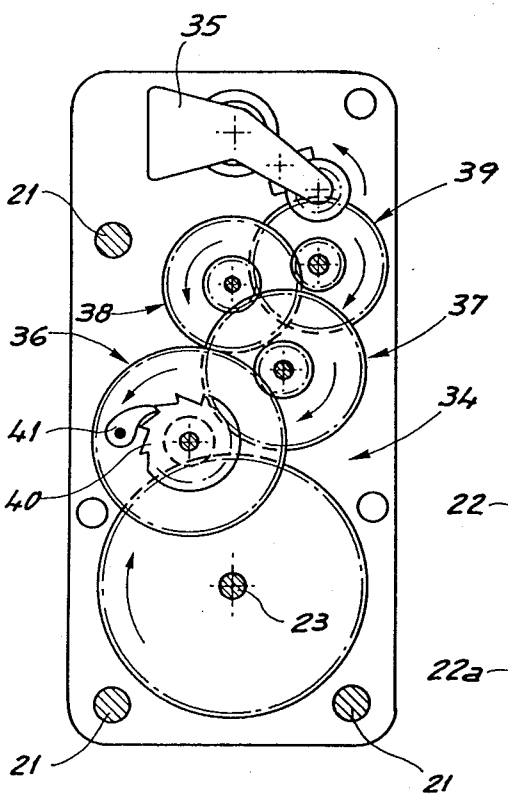
FIG. 6 is a cross-sectional view of the timing device along line VI—VI of FIG. 5.

Each timing device comprises two mounting flanges 20*a*, 20*b* (FIGS. 5 and 6) rigidly connected together by spacers 21. On the external face of the rear flange 20*a* (to the left on FIG. 5) is mounted a barrel 22 containing a spring 22*a*. The shaft 23 of this barrel passes through the flanges 20*a* and 20*b* and terminates on the front side of the timing device with a square-shaped winding piece 23*a* able to receive a winding key 24 (FIGS. 2 and 4). A pinion 25 is keyed on the shaft 23.

The front flange 20*b* carries on its front face a stud 26 on which is rotatably mounted an indicating disk 27 carrying a graduation 28 (FIGS. 1 and 3). The graduation 28 cooperates with an index 29 placed behing a magnifying glass 30. The graduation 28 in this case indicates hours and, for example, extends over 144 hours.

The indicating disk 27 is maintained on the tenon 26 by means of a ring 31 and a screw 32 (FIG. 5) and is provided with teeth that mesh with the pinion 25.

The pinion 25 of barrel 22 carries an escapement wheel 33 of a wheel-train 34 which leads to an escapement-type regulator 35 of conventional type.

The wheel-train 34 includes four wheels 37 to 39. The first wheel 36 has a pinion 40 cooperating with a winding pawl 41.

The second, third and fourth wheels 37 to 39 are multiplying members (gearwheels) that transmit energy to the regulator 35. The wheels 37 and 38 each have a pinion whereas the wheel 39 has a specific construction that will now be described with reference to FIGS. 7 to 9.

The wheel 39 comprises an axle 42 pivotally mounted in the flanges 20*a* and 20*b* and carrying a pinion 43 which meshes with the teeth 38*a* of wheel 38. The axle 42 is fixed for rotation with the cage 44 of a differential mechanism 45. This cage 44 has the general shape of a stirrup or yoke with two lateral branches 44*a*, 44*b* and an intermediate branch 44*c* terminating with an enlarged part 44*d* surrounding the axle 42 and receiving a blocking screw 46 which fixes them together.

Each lateral branch 44*a*, 44*b* is pierced with a hole 44*e* coaxial with the axle 42 to allow passage of a bush 47, 48 of a secondary wheel 49 on the one hand and of a regulator 50 on the other hand. These bushes 47 and 48 are mounted to freely rotate about the axle 42.

The secondary wheel 49 comprises a wheel 51 which meshes with the escapement wheel 52 of the regulators 35, as well as a cog 53 positioned on the opposite end of the bush 47 and which constitutes a planet wheel of the differential mechanism 45. This planet wheel meshes with a satellite pinion 54 of mechanism 45 rotatably mounted in the cage 44.

The regulator 50 comprises a flanged disk 55 cooperating with a planet wheel 56. These two elements are solidly fixed with the bush 48. The planet wheel 56 meshes with a satellite pinion 57 rotatably mounted in the cage 44.

Figure 7:
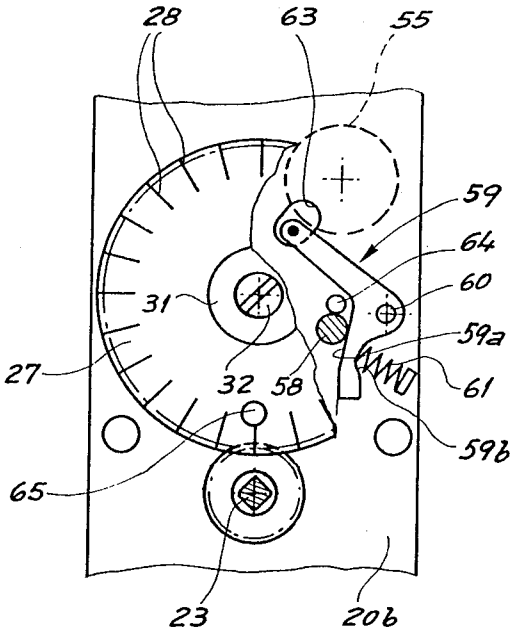
FIG. 7 is a partial front view of the timing device along line VII—VII of FIG. 5.

With reference to FIG. 7, it can be seen that the indicating disk 27 carries a control pin 58 able to cooperate with a lever 59 pivotally mounted at 60 on the front flange 20*b* behind the disk 27 and in a plane parallel to this flange. The lever 59 has an elbow shape and comprises two branches one of which defines a lateral cam surface 59*a* cooperating with the control pin 58 as well as a bearing surface for a biasing spring 61 whose other end bears against the flange 20*b*.

The other branch of lever 59 carries at its free end a locking pin 62 which passes through an opening 63 provided in the flange 20*b* and which is able to act on the flanged disk 55 to prevent it from rotating, if necessary.

A stop pin 64 is additionally provided on the external face of the flange 20*b* in order to stop the timing device when it reaches the end of its path, the stop pin 64 cooperating for this purpose with the control pin 58.

The indicating disk 27 carries on its front face another control pin 65 able to cooperate with the corresponding actuating finger 18*a*, 18*b* or 18*c* of the transmission plate 13.

Operation of the described time lock is as follows.

Suppose the lock is in its configuration shown in FIGS. 1 and 2. The lock may be actuated normally to permit access to and closure of the protected enclosure. When the enclosure must be closed for an extended period of time, for example because of the absence of personnel, the responsible employee will actuate the lock so that it cannot be opened until a displayed time interval has elapsed, i.e. until return of the personnel for example the next morning.

To proceed with closing of the door and scrambling of the coding system of the lock, the employee must act on the actuating lever 9 to move it down then regulate the three timing devices 19*a* to 19*c* to an adequate time interval.

Moving down the actuating lever 9 produces a slight raising of the sliding piece 5, places of the spring 7 under tension and allows the transmission plate 13 to be moved towards the left (looking at FIGS. 1 and 2).

However, the transmission plate 13 can only move to the left when the three timing devices 19*a* to 19*c* have been set and their control pins 65 have moved away from the corresponding fingers 18*a* to 18*c*.

After this setting, closing of the door is followed by actuation of the lock, which moves the bar 3 to the right. The sliding piece 5 is pushed up by the spring 7 which places it across the passage 4 and henceforth prevents any actuation of the lock in the direction to open it.

Figure 8:
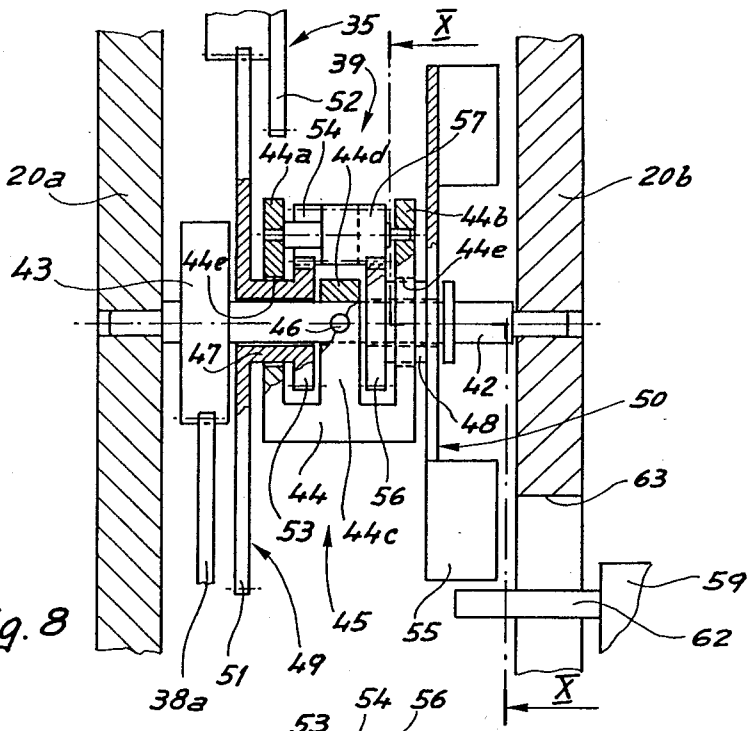
FIG. 8 is a cross-sectional view on an enlarged scale of a part of the timing device of FIGS. 5 to 7.
Figure 9:
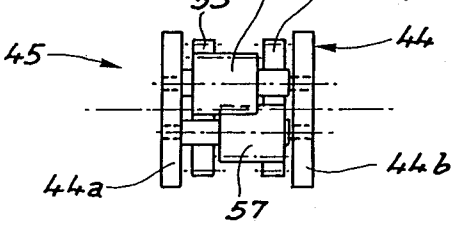
FIG. 9 shows, on a smaller scale than FIG. 8, an external view of a differential used in the timing device.
Figure 10:
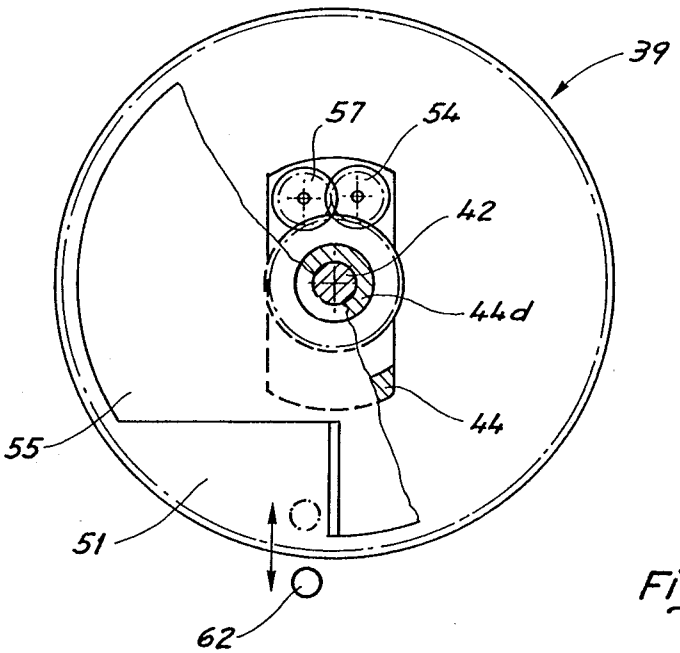
FIG. 10 is a cross-sectional view along line X—X of FIG. 8.

During the setting of each timing device, rotation of the shaft 23 by means of the winding key 24 sets the spring 22*a* and tips the lever 59 clockwise as seen on FIG. 7, which places the locking pin 62 in the trajectory of the flanges of flanged disk 55 (FIG. 8). The movement produced by releasing the energy of spring 22*a* then passes via the wheel-train 34 and the differential mechanism 45 to the escapement wheel 52 of the regulator 35 and the counting of the timing device is carried out with a time base corresponding to the frequency of this regulator.

During counting, the disks 27 of the three timing devices turn in the counterclockwise direction and at the end of the fixed time interval, the control pin 58 actuates the lever 59 in each timing device, hence freeing the corresponding flanged disk 55. As the latter only offers a very low resistance to the differential mechanism 45 and in any event less than that imposed on this mechanism by the regulator 35, the residual energy of the spring 22*a* is abruptly released so that the control pin 58 comes to contact with the corresponding finger 18*a* to 18*c*. The kinetic energy taken up by the wheel-train is amply sufficient to actuate the transmission plate 13 which moves abruptly to the right. The instant when this takes place is precisely determined as it corresponds to freeing of the flanged disk 55. Of course, when as in the present example three timing devices are provided, the instant of freeing of the lock corresponds to that determined by the timing device in which the flanged disk 55 is disengaged first. If the setting is done carefully, it can be arranged that the three timing devices are freed practically at the same time.

Hence, the wheel 39 in which the differential mechanism 45 is incorporated constitutes switching means that modify the running of the timing device by connecting the wheel-train thereof either to the regulator 35 or to the regulator 50.

In the embodiment described above, control of these switching means is automatic and is determined by one of the mobile members (namely the indicating disk 27) of the timing device.

Figure 11:
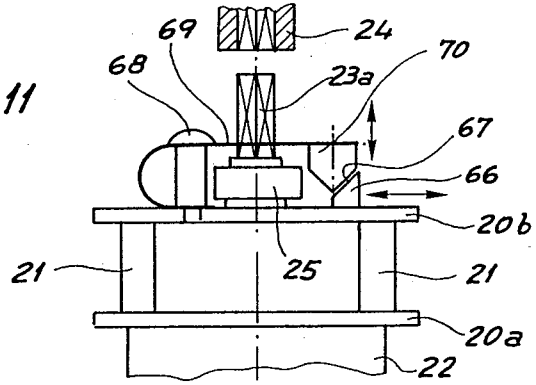
FIG. 11 is an underneath view of an advantageous varied embodiment of the timing device.
Figure 12:
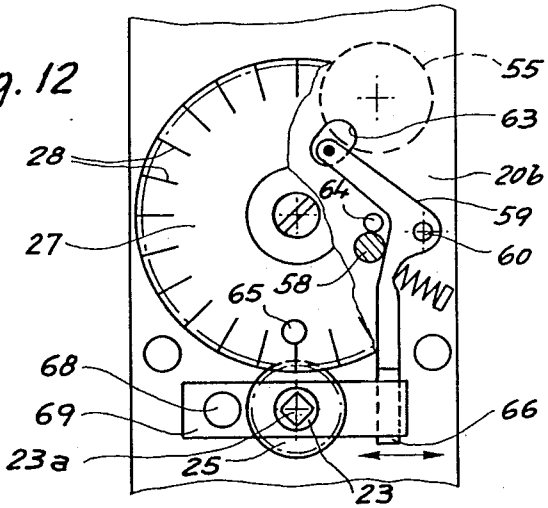
FIG. 12 is a partially cut away front elevatonal view of the timing device of FIG. 11.

FIGS. 11 and 12 show a variation of the invention in which the speed of running can also be increased by the user by means of the winding key 24.

In this variation, the lever 59 comprises an extension 66 whose surface 67 opposite flange 20*b* is slanted to form a cam surface. Additionally, a pin 68 is force-fitted in the flange 20*b* and maintains an elastic blade 69 whose free end carries a lug 70 which comes to bear against the surface 67 to push away the lever 59 and turn it in the same direction as the control pin 58 moves the timing device at the end of its path. The flexion of the elastic blade 69 to urge the lug 70 may be obtained by pushing the winding key 24 axially against the square-shaped winding piece 23*a* towards the flange 20*b*. As soon as the key is released, the blade reassumes its initial position and the lever 59 once more blocks the flanged disk 55. It is clear that in this manner the user can easily accelerate running of the timing device as long as he maintains the winding key 24 pushed against the square-shaped winding piece 23*a*. It is consequently extremely simple to adjust the timing device to the desired time setting, since it suffices to bring the indicating disk 27 slightly beyond the position corresponding to this setting then to move it back by pushing on the key.

The regulator 50 may incorporate a flanged disk 55 as described to confer a given resistance to rotation thereof. Of course, it is also possible to use an inertia disk or a friction disk, for example.

Figure 13:
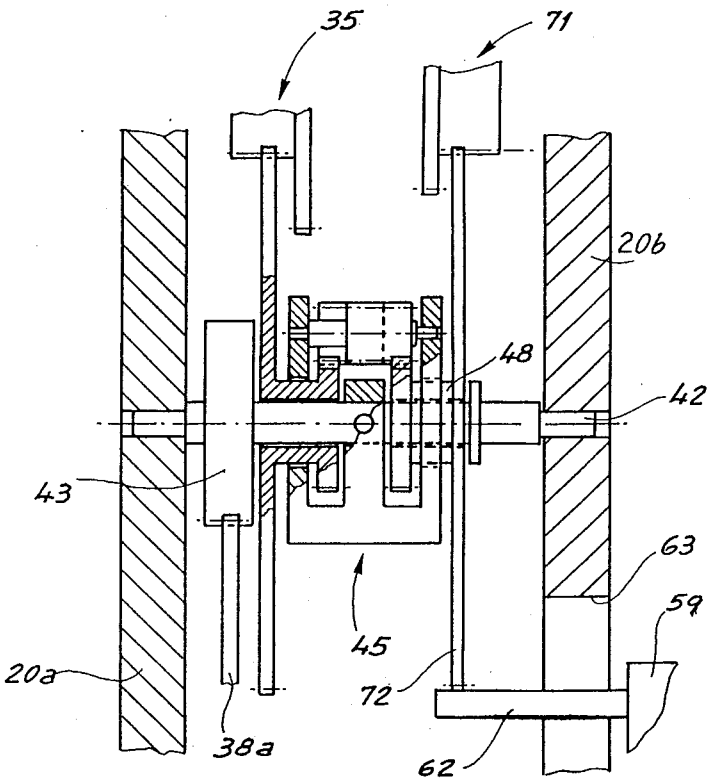
FIG. 13 is an enlarged scale view similar to FIG. 8, showing a detail of the varied embodiment of FIGS. 11 and 12.

However, according to another embodiment of the invention, it is also possible to replace the regulator 50 by an escapement-type regulator 71 (FIG. 13) cooperating with a wheel 72 keyed on the bush 48 of the differential mechanism 45. Such a regulator may be of conventional construction like the first regulator 35 but however having a different frequency. Hence, according to the position of the locking pin 62, it is possible to selectively set the timing device with two different speeds of running, for instance to be able to select a time interval at choice in two different ranges, one for example from 0 to 12 hours and the other from 0 to 144 hours. In this case it is advantageous to provide two corresponding scales on the indicating disk 27 and it is convenient to provide a device enabling the locking pin 62 to be permanently held in either of its two positions. This can easily be achieved by providing a releasable locking member (not shown) associated with the elastic blade 69.

We claim:

1. A time lock comprising a blocking member able to prevent manual actuation of the lock during a time interval fixed by at least one mechanical timing device, this timing device being driven by a spring coupled via a wheel-train to a regulating device, characterized in that the timing device comprises a second regulating device and switching means able to selectively connect to said wheel-train either the first regulating device or the second regulating device to adjust the speed of running of the timing device.

2. A lock according to claim 1, wherein the switching means are associated with control means automatically acting during running of the timing device and movable by the wheel-train thereof.

3. A lock according to claim 1 or 2, wherein the switching means are associated with manual control means for selectively actuating said switching means at a chosen instant of the time setting of the timing device.

4. A lock according to claim 2, wherein said control means are arranged to provide switching onto the second regulating device when the time setting of the time device has elapsed.

5. A lock according to claim 1, wherein the second regulating device sets the timing device with a running speed greater than the running speed of the first regulating device.

6. A lock according to claim 2, comprising a display disk coupled to the wheel-train of the timing device, wherein said automatic control means comprise a pin fixed to said display disk.

7. A lock according to claim 2, wherein said switching means comprise a differential mechanism forming a wheel of the wheel-train immediately preceding said regulating devices.

8. A lock according to claim 7, wherein said second regulating device is of the flanged disk type.

9. A lock according to claim 7, wherein said second regulating device is an escapement-type regulator.

10. A lock according to claim 7, 8 or 9, wherein said switching means comprise a locking member movable between two positions in which it respectively frees and locks the output of said differential coupled to said second regulating device as a function of the position of said control means.

* * * * *